US006394195B1

(12) United States Patent
Schubert et al.

(10) Patent No.: US 6,394,195 B1
(45) Date of Patent: May 28, 2002

(54) METHODS FOR THE DYNAMIC SHUT-IN OF A SUBSEA MUDLIFT DRILLING SYSTEM

(75) Inventors: Jerome J. Schubert, College Station; Carmon H. Alexander, Jonesboro; Hans C. Juvkam-Wold, College Station; Curtis E. Weddle, III, Magnolia, all of TX (US); Jonggeun Choe, Seoul (KR)

(73) Assignee: The Texas A&M University System, College Station, TX (US)

( * ) Notice: Subject to any disclaimer, the term of this patent is extended or adjusted under 35 U.S.C. 154(b) by 0 days.

(21) Appl. No.: 09/731,295

(22) Filed: Dec. 6, 2000

(51) Int. Cl.[7] ..... E21B 7/00

(52) U.S. Cl. ..... 175/69; 175/25; 175/38; 175/48; 175/72; 166/359

(58) Field of Search ..... 175/25, 38, 48, 175/65, 69, 72; 166/358, 359, 363

(56) References Cited

U.S. PATENT DOCUMENTS

| | | | | |
|---|---|---|---|---|
| 3,976,148 A | | 8/1976 | Maus et al. | 175/7 |
| 4,046,191 A | * | 9/1977 | Neath | |
| 4,063,602 A | * | 12/1977 | Howell et al. | |
| 4,709,900 A | * | 12/1987 | Dyhr | |
| 4,813,495 A | | 3/1989 | Leach | 175/6 |
| 6,032,742 A | | 3/2000 | Tomlin et al. | 166/345 |

OTHER PUBLICATIONS

Excerpt from WorldOil.com–Online Magazine–Special Focus entitled, "Subasea MudLift Drilling JIP: Achieving dual–gradient technology", dated Aug. 1999, 8 pages.

J. Choe et al., "Well Control Aspects of Riserless Drilling", Society of Petroleum Engineers Paper No. SPE 49058 dated Sep. 1998, 12 pages.

H. R. Lima et al., "Pressure Calculations and Kick Detection with Synthetic–Based Muds in a Riserless Drilling Configuration", Offshore Technology Conference paper No. OTC 10897 dated May 1999, 12 pages.

H. R. Lima et al., "Computational Hydraulic Analysis of a Deepwater Well Drilled with Synthetic–Based Mud in a Riserless Drilling Configuration", Society of Petrolem Engineers Paper No. SPE 49057 dated Sep. 1998, 6 pages.

Presentation by Hans C. Juvkam–Wold, Texas A&M University entitled "How Does Riserless Differ from Drilling with a Conventional Riser?", dated Nov. 20, 1997, 40 pages.

Presentation by Hans C. Juvkam–Wold and Jonggeun Choe, Texas A&M University entitled "A Comparison Between Riserless Drilling and Conventional Drilling", dated Jul. 30, 1997, 34 pages.

* cited by examiner

*Primary Examiner*—Roger Schoeppel
(74) *Attorney, Agent, or Firm*—Rosenthal & Osha L.L.P.

(57) ABSTRACT

A method for a dynamic shut-in of a subsea mudlift drilling system. The method comprises detecting a kick, isolating a wellbore, and adjusting a subsea mudlift pump and a surface mud pump to provide a selected wellbore pressure. Selected well parameters are measured and used to calculate a kick intensity.

The invention is also a method for a dynamic shut-in of a subsea mudlift drilling system including detecting a kick and isolating a wellbore. A first inlet pressure of a subsea mudlift pump and a first drill pipe pressure are measured. A rate of the subsea mudlift pump and a rate of a surface mud pump are adjusted to pre-kick circulation rates. A second inlet pressure of the subsea mudlift pump and a second drill pipe pressure are recorded. The measured values are used to calculate a kick intensity.

38 Claims, 3 Drawing Sheets

METHODS FOR THE DYNAMIC SHUT-IN OF A SUBSEA MUDLIFT DRILLING SYSTEM

BACKGROUND OF THE INVENTION

1. Technical Field

The invention relates generally to methods and procedures for maintaining well control during drilling operations. More specifically, the invention relates to well control methods and procedures where "riserless" drilling systems are used.

2. Background Art

Exploration companies are continually searching for methods to make deep water drilling commercially viable and more efficient. Conventional drilling techniques are not feasible in water depths of over several thousand feet. Deep water drilling produces unique challenges for drilling aspects such as well pressure control and wellbore stability.

Deep Water Drilling

Deep water drilling techniques have, in the past, typically relied on the use of a large diameter marine riser to connect drilling equipment on a floating vessel or a drilling platform to a blowout preventer stack on a subsea wellhead disposed on the seafloor. The primary functions of the marine riser are to guide a drill string and other tools from the floating vessel to the subsea wellhead and to conduct drilling mud and earth cuttings from a subsea well back to the floating vessel. In deeper waters, conventional marine riser technology encounters severe difficulties. For example, if a deep water marine riser is filled with drilling mud, the drilling mud in the riser may account for a majority of the drilling mud in the circulation system. As water depth increases, the drilling mud volume increases. The large volume of drilling mud requires an excessively large circulation system and drilling vessel. Moreover, an extended length riser may experience high loads from ocean currents and waves. The energy from the currents and waves may be transmitted to the drilling vessel and may damage both the riser and the vessel.

In order to overcome problems associated with deep water drilling, a technique known as "riserless" drilling has been developed. Not all riserless techniques operate without a marine riser. The marine riser may still be used for the purpose of guiding the drill string to the wellbore and for protecting the drill string and other lines that run to and from the wellbore. When marine risers are used, however, they typically are filled with seawater rather than drilling mud. The seawater has a density that may be substantially less than that of the drilling mud, substantially reducing the hydrostatic pressure in the drilling system.

An example of a riserless drilling system is shown in U.S. Pat. No. 4,813,495 issued to Leach and assigned to the assignee of the present invention. A riserless drilling system 10 of the '495 patent is shown in FIG. 1 and comprises a drill string 12 including drill bit 20 and positive displacement mud motor 30. The drill string 12 is used to drill a wellbore 13. The system 10 also includes blowout preventer stack 40, upper stack package 60, mud return system 80, and drilling platform 90. As drilling is initiated, drilling mud is pumped down through the drill string 12 through drilling mud line 98 by a pump which forms a portion of mud processing unit 96. The drilling mud flow operates mud motor 30 and is forced through the bit 20. The drilling mud is forced up a wellbore annulus 13A and is then pumped to the surface through mud return system 80, mud return line 82, and subsea mudlift pump 81. This process differs from conventional drilling operations because the drilling mud is not forced upward to the surface through a marine riser annulus.

The blowout preventer stack 40 includes first and second pairs of ram preventers 42 and 44 and annular blowout preventer 46. The blowout preventers ("BOP"s) may be used to seal the wellbore 13 and prevent drilling mud from travelling up the annulus 13A. The ram preventers 42 and 44 include pairs of rams (not shown) that may seal around or shear the drill string 12 in order to seal the wellbore 13. The annular preventer 46 includes an annular elastomeric member that may be activated to sealingly engage the drill string 12 and seal the wellbore 13. The blowout preventer stack 40 also includes a choke/kill line 48 with an adjustable choke 50. The choke/kill line 48 provides a flow path for drilling mud and formation fluids to return to the drilling platform 90 when one or more of the BOPs (42, 44, and 46) have been closed.

The upper end of the BOP stack 40 may be connected to the upper stack package 60 as shown in FIG. 1. The upper stack package 60 may be a separate unit that is attached to the blowout preventer stack 40, or it may be the uppermost element of the blowout preventer stack 40. The upper stack package 60 includes a connecting point 62 to which mud return line 82 is connected. The upper stack package 60 may also include a rotating head 70. The rotating head 70 may be a subsea rotating diverter ("SRD") that has an internal opening permitting passage of the drill string 12 through the SRD. The SRD forms a seal around the drill string 12 so that the drilling mud filled annulus 13A of the wellbore 13 is hydraulically separated from the seawater. The rotating head 70 typically includes both stationary elements that attach to the upper stack package 40 and rotating elements that sealingly engage and rotate with the drill string 12. There may be some slippage between rotating elements of the rotating head 70 and the drill string 12, but the hydraulic seal is maintained. During drill pipe "trips" to change the bit 20, the rotating head 70 is typically tripped into the hole on the drill string 12 before fixedly and sealingly engaging the upper stack package 60 that is connected to the BOP stack 40.

The lower end of the BOP stack 40 may be connected to a casing string 41 that is connected to other elements (such as casing head flange 43 and template 47) that form part of a subsea wellhead assembly 99. The subsea wellhead assembly 99 is typically attached to conductor casing that may be cemented in the first portion of the wellbore 13 that is drilled in the seafloor 45. Other portions of the wellbore 13, including additional casing strings, well liners, and open hole sections extend below the conductor casing.

The mud return system 80 includes the subsea mudlift pump 81 that is positioned in the mud return line 82 adjacent to the upper stack package 60. The subsea mudlift pump 81 in the '495 patent is shown as a centrifugal pump that is powered by a seawater driven turbine 83 that is, in turn, driven by a seawater transmitting powerfluid line 84. The mud return system 80 boosts the flow of drilling mud from the seafloor 45 to the drilling mud processing unit 96 located on the drilling platform 90. Drilling mud is then cleaned of cuttings and debris and recirculated through the drill string 12 through drilling mud line 98.

Subsea Well Control

When drilling a well, particularly an oil or gas well, there exists the danger of drilling into a formation that contains fluids at pressures that are greater than the hydrostatic fluid pressure in the wellbore. When this occurs, the higher pressure formation fluids flow into the well and increase the fluid volume and fluid pressure in the wellbore. The influx of formation fluids may displace the drilling mud and cause the drilling mud to flow up the wellbore toward the surface. The formation fluid influx and the flow of drilling and formation fluids toward the surface is known as a "kick." If the kick is not subsequently controlled, the result may be a "blowout" in which the influx of formation fluids (which, for example, may be in the form of gas bubbles that expand near the surface because of the reduced hydrostatic pressure) blows the drill string out of the well or otherwise destroys a drilling apparatus. An important consideration in deep water drilling is controlling the influx of formation fluid from subsurface formations into the well to control kicks and prevent blowouts from occurring.

Drilling operations typically involve maintaining the hydrostatic pressure of the drilling mud column above the formation fluid pressure. This is typically done by selecting a specific drilling mud density and is typically referred to as "overbalanced" drilling. At the same time, however, the bottom hole pressure of the drilling mud column must be maintained below a formation fracture pressure. If the bottom hole pressure exceeds the formation fracture pressure, the formation may be damaged or destroyed and the well may collapse around the drill string.

A different type of drilling regime, known as "underbalanced" drilling, may be used to optimize the rate of penetration ("ROP") and the efficiency of a drilling assembly. In underbalanced drilling, the hydrostatic pressure of the drilling mud column is typically maintained lower than the fluid pressure in the formation. Underbalanced drilling encourages the flow of formation fluids into the wellbore. As a result, underbalanced drilling operations must be closely monitored because formation fluids are more likely to enter the wellbore and induce a kick.

Once a kick is detected, the kick is typically controlled by "shutting in" the wellbore and "circulating out" the formation fluids that entered the wellbore. Referring again to FIG. 1, a well is typically shut in by closing one or more BOPs (42, 44, and/or 46). The fluid influx is then circulated out through the adjustable choke 50 and the choke/kill line 48. The choke 50 is adjustable and may control the fluid pressure in the well by allowing a buildup of back pressure (caused by pumping drilling mud from the mud processing unit 96) so that the kick may be circulated through the drilling mud processing unit 96 in a controlled process. The drilling mud processing unit 96 has elements that may remove any formation fluids, including both liquids and gases, from the drilling mud. The drilling mud processing unit 96 then recirculates the "cleaned" drilling mud back through the drill string 12. Typically, as the kick is circulated out, the drilling mud that is being pumped back into the wellbore 13 through drill string 12 has an increased density of a preselected value. The resulting increased hydrostatic pressure of the drilling mud column may equal or exceed the formation pressure at the site of the kick so that further kicks are prevented. This process is referred to as "killing the well." The kick is circulated out of the wellbore and the drilling mud density is increased in substantially one complete circulation cycle (for example, by the time the last remnants of the drilling mud with the pre-kick mud density have been circulated out of the well, mud with the post-kick mud density has been circulated in as a substitute). When the wellbore is stabilized, drilling operations may be resumed or the drill string 12 may be tripped out of the wellbore 13. This method of controlling a kick is typically referred to as the "Wait and Weight" method. The Wait and Weight Method has historically been the preferred method of circulating out a kick because it generally exerts less pressure on the wellbore 13 and the formation and requires less circulating time to remove the influx from the drilling mud.

Another method for controlling a kick is typically referred to as the "Driller's Method." Generally, the Driller's Method is accomplished in two steps. First, the kick is circulated out of the wellbore 13 while maintaining the drilling mud at an original mud weight. This process typically takes one complete circulation of the drilling mud in the wellbore 13. Second, drilling mud with a higher mud weight is then pumped into the wellbore 13 to overcome the higher formation pressure that produced the kick. Therefore, the Driller's Method may be referred to as a "two circulation kill" because it typically requires at least two complete circulation cycles of the drilling mud in the wellbore 13 to complete the process.

A device known as a drill string valve ("DSV") may be used as a component of either of the previously referenced well control methods. A DSV is typically located near a bottom hole assembly and includes a spring activated mechanism that is sensitive to the pressure inside the drill string. When drill string pressure is lowered below a preselected level, the spring activates a flow cone that moves to block flow ports in a flow tube. In order for drilling mud to flow through the drill string, the flow ports must be at least partially open. Thus, the DSV permits flow through the drill string if sufficient surface pump pressure is applied to the drilling fluid column, and the DSV typically only permits flow in one direction so that it act as a check valve against mud flowing back toward the surface.

The spring pressure in the DSV may be adjusted to account for factors such as the depth of the wellbore, the hydrostatic pressure exerted by the drilling mud column, the hydrostatic pressure exerted by the seawater from a drilling mud line to the surface, and the diameter of drill pipe in the drill string. The drilling mud line may be defined as a location in a well where a transition from seawater to drilling mud occurs. For example, in the system 10 shown in FIG. 1, the drilling mud line is defined by the hydraulic seal of the rotating head 70 that separates the drilling mud of the wellbore annulus 13A from seawater. The DSV may be used to stop drilling mud from experiencing "free-fall" when the mud circulation pumps are shut down and the well is shut-in.

Using the system of the Leach '495 patent as an example, when the pumps of the mud processing unit 96 are shut down and no DSV is present in the drill string 12, the mud column hydrostatic pressure in the drill string 12 is greater than the sum of the hydrostatic pressure of the drilling mud in the wellbore annulus 13A and a suction pressure generated by the subsea mudlift pump 81. Drilling mud, therefore, free-falls in the drill string into the wellbore annulus 13A until the hydrostatic pressure of the mud column in the drill string 12 is equalized with the sum of the hydrostatic pressure of the drilling mud in the wellbore annulus 13A and the mudlift pump 81 suction pressure. Thus, the well continues to flow while equilibrium is established. The continued flow of drilling mud in the well after pump shut-down may typically be referred to as an "unbalanced U-tube" effect. The DSV, which should be in a closed position after the pumps are shut-down, may prevent the free-fall of drilling mud in the wellbore that may be attributable to the unbalanced U-tube.

In contrast, in conventional drilling systems where drilling mud is returned to the surface through the wellbore annulus, the drilling mud circulation system forms a "balanced U-tube" because there is no flow of drilling mud in the well after the surface pumps are shut down. The well does not flow because the hydrostatic pressure of the drilling mud in the drill string is balanced with the hydrostatic pressure of the mud in the wellbore annulus.

Well control procedures may be complicated by a leaking DSV. For example, the spring in the DSV must be adjusted correctly so that it will activate the flow cone and block the flow ports when pressure is removed from the mud column such as by shutting down the surface mud pumps. If the flow ports remain at least partially open, the well will continue to flow after all the pumps have been shut down and/or after the well has been fully shut-in. Further, the DSV may develop leaks from flow erosion, corrosion, or other factors.

Typically, there are two conditions where the DSV may be checked for leaks. The first condition is during normal drilling operations when, for example, circulation of drilling mud is stopped so that a drill pipe connection may be made (all pumps must be shut off for the DSV check). In this case, an effort is made to distinguish between a leaking DSV and a possible kick. The second condition occurs after the well has been fully shut-in on a kick (again, all pumps must be shut off for the DSV check). In this case, an effort is made to distinguish between a leaking DSV and additional flow that may have entered the well from the known kick. In both cases it is important to check the DSV for leaks because otherwise it may be difficult to determine if additional flow in the well is due to a leaking or partially open DSV or to additional flow that has entered the well from a kick.

Reliable methods are needed to quickly and efficiently control and eliminate kicks that are experienced when drilling wells. The methods must account for the special configurations of deepwater drilling systems and must function both with and without the use of a DSV. The methods must also be designed to determine the difference between a leaking DSV and a kick that may have occurred during drilling operations, and also between a leaking DSV and additional flow that may occur after a kick is shut-in. In either case, the kicks come from formations with pore pressures that exceed the fluid pressure in the wellbore. Finally, the methods should result in a hydrostatically "dead" well so that the drill string may be removed from the wellbore or so that drilling operations may resume.

SUMMARY OF THE INVENTION

One aspect of the invention is a method for a dynamic shut-in of a subsea mudlift drilling system. The method comprises detecting a kick, isolating a wellbore, and adjusting a subsea mudlift pump and a surface mud pump to provide a selected wellbore pressure. Selected well parameters are measured and used to calculate a kick intensity.

Another aspect of the invention is a method for a dynamic shut-in of a subsea mudlift drilling system comprising detecting a kick and isolating a wellbore. A first inlet pressure of a subsea mudlift pump and a first drill pipe pressure are measured. A rate of the subsea mudlift pump and a rate of a surface mud pump are adjusted to pre-kick circulation rates. A second inlet pressure of the subsea mudlift pump and a second drill pipe pressure are measured. The measurements are used to calculate a kick intensity.

Other aspects and advantages of the invention will be apparent from the following description and the appended claims.

DETAILED DESCRIPTION

Figure 1:
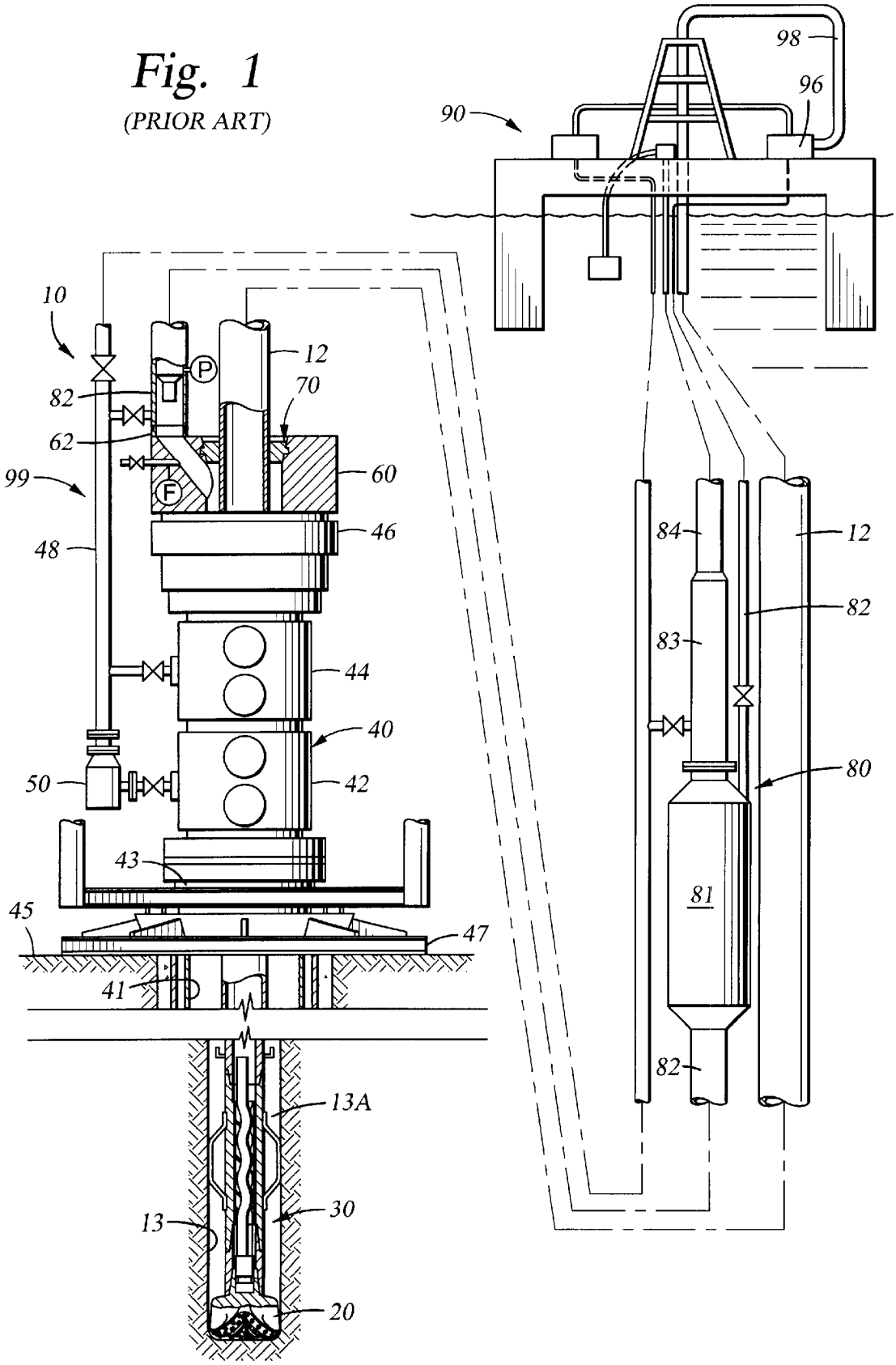
Fig. 1 (PRIOR ART)
FIG. 1 shows a schematic view of a prior art riserless drilling system.
Figure 2:
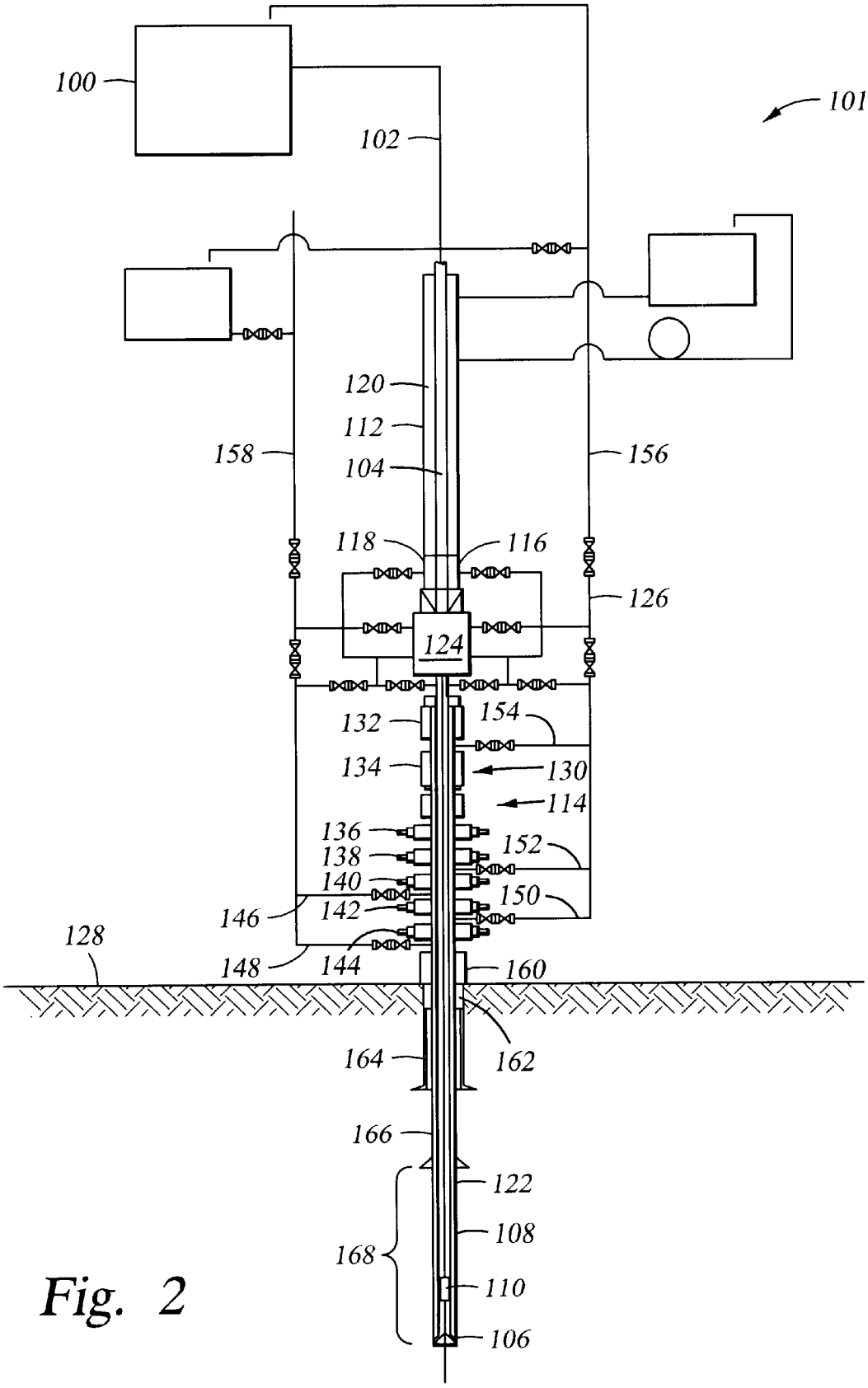
FIG. 2 shows an example of a typical system used in an embodiment of the invention.

FIG. 2 shows an example of a typical drilling system 101 used in an embodiment of the invention. The drilling system 101 presented in the example is provided for illustration of the methods used in the present invention and is not intended to limit the scope of the invention. The methods of the invention may function in arrangements that differ from the drilling system 101 shown in FIG. 2.

The drilling system 101 has a surface drilling mud circulation system 100 that includes a drilling mud storage tank (not shown separately) and surface mud pumps (not shown separately). The surface drilling mud circulation system 100 and other surface components of the drilling system 101 are located on a drilling platform (not shown) or a floating drilling vessel (not shown). The surface drilling mud circulation system 100 pumps drilling mud through a surface pipe 102 into a drill string 104. The drill string 104 may include drill pipe (not shown), drill collars (not shown), a bottom hole assembly (not shown), and a drill bit 106 and extends from the surface to the bottom of a well 108. The drill string 104 may also include a drill string valve 110.

The drilling system 101 may include a marine riser 112 that extends from the surface to a subsea wellhead assembly 114. The marine riser 112 forms an annular chamber 120 that is typically filled with seawater. A lower end of the marine riser 112 may be connected to a subsea accumulator chamber ("SAC") 116. The SAC 116 may be connected to a subsea rotating diverter 118. The SRD 118 functions to rotatably and sealingly engage the drill string 104 and separates drilling mud in a wellbore annulus 122 from seawater in an annular chamber 120 of the marine riser 112.

A discharge port of the SRD 118 may be connected to an inlet of a subsea mudlift pump ("MLP") 124. An outlet of the MLP 124 is connected to a mud return line 126 that returns drilling mud from the wellbore annulus 122 to the surface drilling mud circulation system 100. The MLP 124 typically operates in an automatic rate control mode so that an inlet pressure of the MLP 124 is maintained at a constant level. Typically, the MLP 124 inlet pressure is maintained at a level equal to the seawater hydrostatic pressure at the depth of the MLP 124 inlet plus a differential pressure that may be, for example, 50 psi. However, the MLP 124 pumping rate may be adjusted so that back pressure may be generated in the wellbore annulus 122. The MLP 124 may be a centrifugal pump, a triplex pump, or any other type of pump known in the art that may function to pump drilling mud from the seafloor 128 to the surface. Moreover, the MLP 124 may be powered by any means known in the art. For example, the MLP 124 may be powered by a seawater powered turbine or by seawater pumped under pressure from an auxiliary pump.

The inlet of the MLP 124 may be connected to a top of a blowout preventer stack 130. The BOP stack 130 may be of any design known in the art and may contain several different types of BOP. As an example, the BOP stack 130 shown in FIG. 2 includes an upper annular BOP 132, a lower annular BOP 134, an upper casing shear ram preventer 136, a shear ram preventer 138, and upper, middle, and lower pipe ram preventers 140, 142, and 144. The BOP stack 130 may have a different number of preventers if desired, and the number, type, size, and arrangement of the blowout preventers is not intended to limit the scope of the invention.

The BOP stack 130 also includes isolation lines such as lines 146, 148, 150, 152, and 154 that permit drilling mud to be circulated through choke/kill lines 156 and 158 after any of the BOPs have been closed. The isolation lines (146, 148, 150, 152, and 154) and choke/kill lines (156 and 158) may be selectively opened or closed. The isolation lines (146, 148, 150, 152, and 154) and the choke/kill lines (156 and 158) are important to the function of the invention because drilling mud must be able to flow in a controlled manner from the surface, through the well, and back after the BOPs are closed.

A lower end of the BOP stack 130 may be connected to a wellhead connector 160 that may be attached to a wellhead housing 162 positioned near the seafloor 128. The wellhead housing 162 may typically be connected to conductor pipe (also referred to as conductor casing) 164 that is cemented in place in the well 108 near the seafloor 128. Additional casing strings, such as casing string 166, may be cemented in the well 108 below the conductor pipe 164. Furthermore, additional casing and liners may be used in the well 108 as required.

Figure 3:
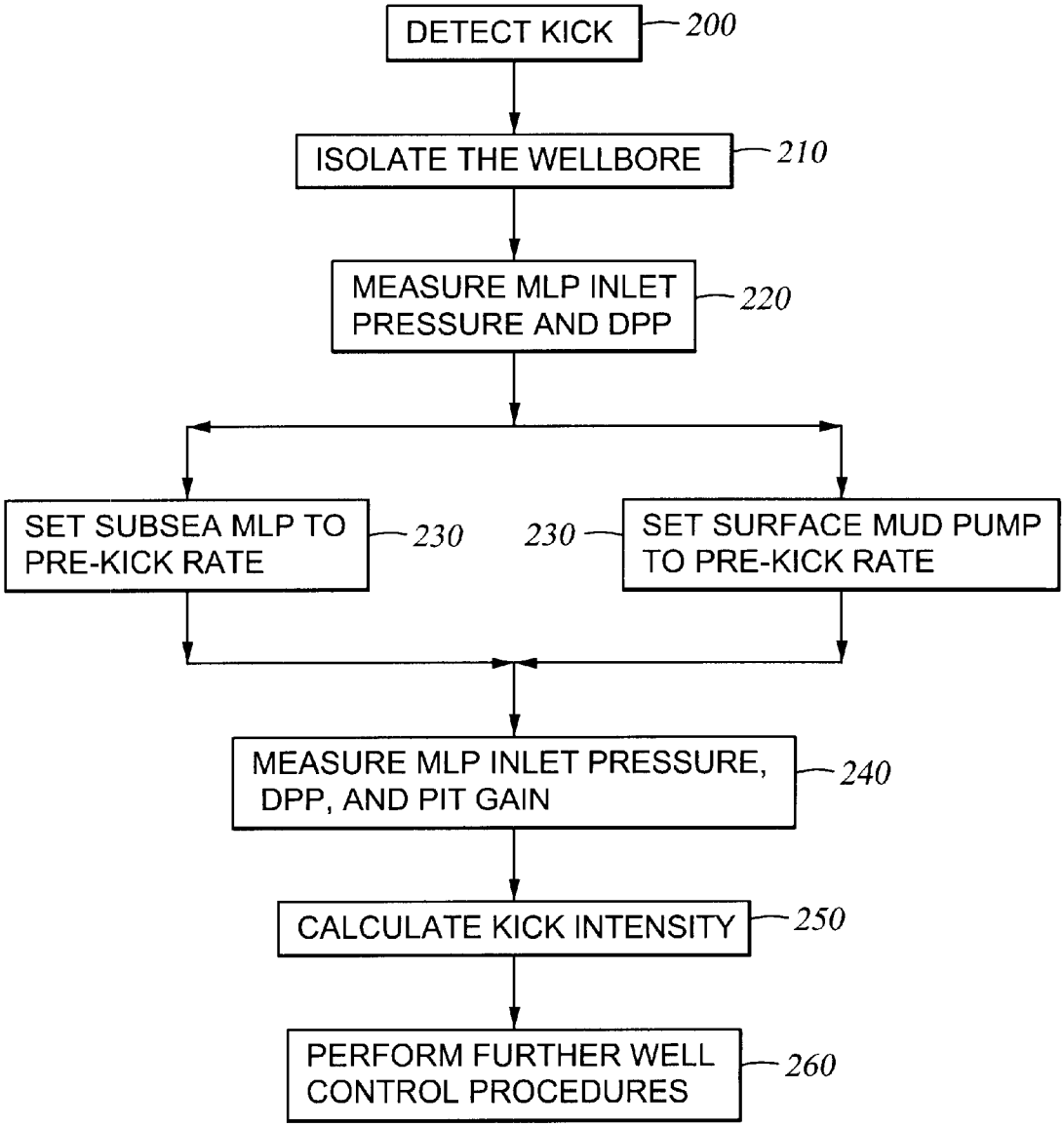
FIG. 3 shows a flow chart of a dynamic shut-in procedure in an embodiment of the invention.

When drilling a well 108, kicks may be encountered when a formation fluid (or "pore") pressure is greater than a hydrostatic pressure in the wellbore 168. Control of the kick is critical to the safety of personnel on the drilling platform or drilling vessel. Moreover, control of the kick is critical to preserving the integrity of the environment. Therefore, a dynamic shut-in procedure, an example of which is shown in FIG. 3, has been developed that may enable the well (108 in FIG. 2) to be shut-in, a kick intensity to be determined, and the kick to be killed so that drilling operations may resume. The flowchart of FIG. 3 serves as an example of an embodiment of the invention. However, the dynamic shut-in procedure may be modified, and the embodiment shown in FIG. 3 is not intended to limit the scope of the invention.

The dynamic shut-in procedure begins with detection of the formation fluid influx, or kick, as shown in block 200 of FIG. 3. Potential kick indicators may include, for example, a "drilling break" where the rate of penetration ("ROP") increases substantially, an increase in the MLP (124 in FIG. 2) rate, a volume gain in a riser trip tank (not shown), a volume increase in a surface mud tank (not shown) that forms a part of the surface drilling mud circulation system (100 in FIG. 2), and continued flow in the well (108 in FIG. 2) after the surface mud pumps are shut down and after the U-tube has been permitted to flow. Other kick indicators exist, however, and the choice of a kick indicator is not intended to limit the scope of the dynamic shut-in procedure. A preferred indicator, however, is an increase in the MLP (124 in FIG. 2) rate. The MLP (124 in FIG. 2) rate may be calculated, for example, with a device such as a flow-meter or by a device that counts pump strokes or pump revolutions per minute.

After a kick has been detected, the wellbore (168 in FIG. 2) may be isolated (as shown at block 210) so that the dynamic shut-in procedure may continue. The wellbore (168 in FIG. 2) is isolated by forming a controlled hydraulic seal between the well (108 in FIG. 2) and the rest of the system (101 in FIG. 2). A first step is to lift the drill string (104 in FIG. 2) and the drill bit (106 in FIG. 2) off of a bottom of the well (108 in FIG. 2). This may be achieved, for example, by raising a top drive or a kelly on the drilling platform or drilling vessel. A bypass line, such as isolation line (154 in FIG. 2), may be opened prior to the closing of at least one BOP (such as upper annular BOP 132 in FIG. 2). Opening the isolation line (154 in FIG. 2) permits drilling mud to flow through the MLP (124 in FIG. 2) after the upper annular BOP (132 in FIG. 2) sealingly engages the drill string (104 in FIG. 2). The closing of the upper annular BOP (132 in FIG. 2) is a well control measure that may prevent a kick from circulating up from the bottom of the well (108 in FIG. 2) to the SRD (118 in FIG. 2) and, subsequently, into the annulus (120 in FIG. 2) of the marine riser (112 in FIG. 2). The SAC (116 in FIG. 2) may typically be isolated from the well (108 in FIG. 2) during normal drilling operations to prevent a gas influx from entering the marine riser (112 in FIG. 2). However, if the SAC (116 in FIG. 2) is not isolated from the well (108 in FIG. 2), it may be isolated by closing an SRD bypass line (not shown) or by closing SAC isolation valves (not shown).

The MLP (124 in FIG. 2) inlet pressure and the drill pipe pressure (DPP) are measured and recorded (as shown at block 220) for use in later calculations of the kick intensity. The MLP (124 in FIG. 2) rate is then adjusted to a pre-kick circulating rate, as shown at block 230. The adjustment is typically required because the MLP (124 in FIG. 2) rate may increase because of the increase in the fluid volume in the well (108 in FIG. 2) caused by the influx. The MLP (124 in FIG. 2) rate may be adjusted to increase the bottom hole pressure (BHP) to a level sufficient to stop the flow from the formation. However, the MLP (124 in FIG. 2) rate must be carefully monitored so that it does not fall below a rate that raises the MLP (124 in FIG. 2) inlet pressure above a predetermined level. For example, if lowering the MLP (124 in FIG. 2) rate raises the MLP (124 in FIG. 2) inlet pressure above a predetermined level, the wellbore (168 in FIG. 2) pressure may exceed the formation fracture pressure. Exceeding the formation fracture pressure may damage the wellbore (168 in FIG. 2) or may cause the wellbore (168 in FIG. 2) to collapse around the drill string (104 in FIG. 2).

If the MLP (124 in FIG. 2) fails to respond to control signals designed to adjust the MLP (124 in FIG. 2) rate, the surface pumps may be shut down and fluid from the well (108 in FIG. 2) may be diverted to an auxiliary line (not shown), such as a seawater filled boost line, in order to control the kick. Diversion of well (108 in FIG. 2) fluid to the auxiliary line is preferable to diverting fluid to the SAC (116 in FIG. 2) or to the marine riser (112 in FIG. 2) because of the possibility of gas entry into the riser (112 in FIG. 2). Moreover, as long as the wellbore (168 in FIG. 2) volume per foot is larger than the volume per foot of the auxiliary line, the kick may tend to "self-kill" when the fluid is diverted.

As the MLP (124 in FIG. 2) rate is adjusted to the pre-kick circulating rate, the surface mud pumps are substantially simultaneously adjusted to a pre-kick circulating rate (also shown at block 230). The adjustment of the surface mud pumps is necessary when the surface mud pump rate has also changed because of the kick. Typically, the surface mud pump rate will increase after a kick because of the loss of hydrostatic pressure in the annulus (122 in FIG. 2) due to the presence of "light" (e.g., less dense) fluid from the influx. After the surface mud pump rate and the MLP (124 in FIG. 2) rate are adjusted to pre-kick circulating rates, the DPP is monitored to determine when it is stable.

When the DPP has stabilized, the MLP (124 in FIG. 2) inlet pressure, the DPP, and a "mud pit gain" are measured and recorded, as shown at block 240. The mud pit gain refers to a mud volume increase of the surface mud circulation system (100 in FIG. 2) storage tanks that are also known as "pits." If a fluid influx has entered a well (108 in FIG. 2), the mud volume in the pits may be greater than the volume contained in the pits while circulating prior to the kick. The increase in mud volume is known as the "pit gain." When the DPP and the MLP (124 in FIG. 2) inlet pressure stabilize, the well is "dynamically dead" and the dynamic shut-in procedure is complete.

The pressures recorded before and after the MLP (124 in FIG. 2) rate and the surface pump rate have been adjusted may be compared to determine the kick intensity (block 250). The increase in the DPP is typically a dynamic underbalance pressure ("DUP"). The DUTP is equivalent to a conventional shut-in drill pipe pressure ("SIDP") minus an annular friction pressure (AFP). The AFP is a pressure loss experienced because of the friction between the drilling mud and annular surfaces (outer walls of the drill string (104 in FIG. 2) and inner walls of the well (108 in FIG. 2)). The AFP is typically estimated by methods known in the art for a given drilling arrangement. For example, factors that may be considered in estimating the AFP include a drilling mud flow rate, a depth of the well (108 in FIG. 2), a drilling mud viscosity, a bottom hole assembly configuration, and a wellbore (168 in FIG. 2) configuration. However, other factors may be accounted for and the factors used in the estimation are not intended to limit the scope of the invention. Therefore, if an estimated AFP is known for the system (101 in FIG. 2), the conventional SIDP may be determined as:

$$SIDP=DUP+AFP.$$

The SIDP may be substantially equal to the kick intensity where the kick intensity may be defined as, for example, an excess of formation fluid (pore) pressure above a fluid pressure in the wellbore (168 in FIG. 2). The determination of the kick intensity is important to further well control procedures, particularly procedures used to "statically kill" the well (108 in FIG. 2). For example, the kick intensity must be known so that a kill mud weight may be determined so that drilling mud with the kill mud weight may be circulated into the well (108 in FIG. 2) to at least balance the formation pore pressure that induced the kick.

After the well has been dynamically killed, further steps may be taken in the well control procedure (as shown at block 260). For example, a check for leaks in the drill string valve (110 in FIG. 2) may be performed as disclosed in the method of co-pending U.S. application Ser. No. 09/730,891, filed on even date herewith, titled "Method for Detecting a Leak in a Drill String Valve," and assigned to the assignee of the present invention. The well may then be statically killed by the method disclosed in co-pending U.S. application Ser. No. 09/731,294, filed on even date herewith, titled "Controlling a Well in a Subsea Mudlift Drilling System," and assigned to the assignee of the present invention. However, regardless of further well control procedures that may be performed, the dynamic shut-in procedure establishes control of the well (108 in FIG. 2) and permits efficient, safe well control that may protect personnel, drilling equipment, and the environment.

Those skilled in the art will appreciate that other embodiments of the invention can be devised which do not depart from the spirit of the invention as disclosed herein. Accordingly, the scope of the invention should be limited only by the attached claims.

What is claimed is:

1. A method for a dynamic shut-in of a well in a subsea mudlift drilling system, the method comprising:

detecting a kick;

isolating a wellbore;

adjusting a subsea mudlift pump and a surface mud pump to provide a wellbore pressure selected to stop flow from the kick;

measuring selected well parameters; and using the measured well parameters to calculate a kick intensity.

2. The method of claim 1, wherein the detecting comprises observing a drilling break.

3. The method of claim 1, wherein the detecting comprises observing an increase in a rate of the subsea mudlift pump.

4. The method of claim 1, wherein the detecting comprises observing a volume gain in a riser trip tank.

5. The method of claim 1, wherein the detecting comprises measuring a pit gain.

6. The method of claim 1, wherein the detecting comprises observing flow in a well when the surface mud pump is shut down.

7. The method of claim 1, wherein the isolating comprises shutting at least one blowout preventer.

8. The method of claim 7, wherein the blowout preventer comprises an annular preventer.

9. The method of claim 7, wherein the blowout preventer comprises a ram preventer.

10. The method of claim 1, wherein the isolating comprises opening at least one isolation line to permit drilling mud to flow through the subsea mudlift pump.

11. The method of claim 1, wherein the isolating comprises isolating a subsea rotating diverter by closing a blowout preventer below the subsea rotating diverter.

12. The method of claim 1, wherein the isolating comprises isolating a subsea accumulator chamber.

13. The method of claim 12, wherein the sub sea accumulator chamber is isolated by closing a sub sea rotating diverter bypass line.

14. The method of claim 12, wherein the subsea accumulator chamber is isolated by closing at least one valve.

15. The method of claim 1, wherein the measured well parameters comprise:

a pre-kick inlet pressure of the subsea mudlift pump;

a pre-kick drill pipe pressure;

a post-kick inlet pressure of the subsea mudlift pump; and a post-kick drill pipe pressure.

16. The method of claim 1, wherein a rate of the sub sea mudlift pump is adjusted to a pre-kick circulation rate.

17. The method of claim 1, wherein a rate of the surface mud pump is adjusted to a pre-kick circulation rate.

18. The method of claim 1, wherein the selected wellbore pressure is below a formation fracture pressure.

19. The method of claim 1, wherein drilling mud from the well is diverted to an auxiliary bypass line if the rate of the sub sea mudlift pump cannot be adjusted.

20. The method of claim 1, the method further comprising lifting a drill string off a bottom of the wellbore after the kick has been detected.

21. A method for a dynamic shut-in of a well in a subsea mudlift drilling system, the method comprising:

detecting a kick;

isolating a wellbore;

measuring a first inlet pressure of a subsea mudlift pump;

measuring a first drill pipe pressure;

adjusting a rate of the subsea mudlift pump to a pre-kick circulation rate;

adjusting a rate of a surface mud pump to a pre-kick circulation rate;

measuring a second inlet pressure of the subsea mudlift pump;

measuring a second drill pipe pressure; and using the measurements to calculate a kick intensity.

22. The method of claim 21, wherein the detecting comprises observing a drilling break.

23. The method of claim 21, wherein the detecting comprises observing an increase in the rate of the subsea mudlift pump.

24. The method of claim 21, wherein the detecting comprises observing a volume gain in a riser trip tank.

25. The method of claim 21, wherein the detecting comprises measuring a pit gain.

26. The method of claim 21, wherein the detecting comprises observing flow in a well when the surface mud pump is shut down.

27. The method of claim 21, wherein the isolating comprises shutting at least one blowout preventer.

28. The method of claim 27, wherein the blowout preventer comprises an annular preventer.

29. The method of claim 27, wherein the blowout preventer comprises a ram preventer.

30. The method of claim 21, wherein the isolating comprises opening at least one isolation line to pen-nit drilling mud to flow through the sub sea mudlift pump.

31. The method of claim 21, wherein the isolating comprises isolating a sub sea rotating diverter by closing a blowout preventer below the subsea rotating diverter.

32. The method of claim 21, wherein the isolating comprises isolating a subsea accumulator chamber.

33. The method of claim 32, wherein the sub se a accumulator chamber is isolated by closing a subsea rotating diverter bypass line.

34. The method of claim 32, wherein the subsea accumulator chamber is isolated by closing at least one valve.

35. The method of claim 21, the method further comprising:

measuring a mud pit gain after the rate of the subsea mudlift pump and the rate of the surface pump have been adjusted to the pre-kick circulation rates; and calculating the kick intensity from the mud pit gain.

36. The method of claim 21, wherein the rate of the subsea mudlift pump is maintained above a selected level so that a wellbore pressure is maintained below a formation fracture pressure.

37. The method of claim 21, wherein drilling mud from the well is diverted to an auxiliary bypass line if the subsea mudlift pump cannot be adjusted.

38. The method of claim 21, the method further comprising lifting a drill string off a bottom of the wellbore after the kick has been detected.

* * * * *

UNITED STATES PATENT AND TRADEMARK OFFICE

CERTIFICATE OF CORRECTION

PATENT NO. : 6,394,195 B1
DATED : May 28, 2002
INVENTOR(S) : Jerome J. Schubert et al.

It is certified that error appears in the above-identified patent and that said Letters Patent is hereby corrected as shown below:

Title page,
Item [73], please change the Assignee to read:
-- The Texas A&M University System, College Station, Texas Conoco, Inc., Houston, Texas --

Column 9,
Line 8, please replace "DUTP" with -- DUP --.

Column 10,
Lines 32 and 33, in both occurrences, please replace "sub sea" with -- subsea --;
Lines 44 and 52, please replace "sub sea" with -- subsea --.

Column 11,
Line 24, please replace "pen-nit" with -- permit --;
Lines 25 and 27, please replace "sub sea" with -- subsea --.

Column 12,
Line 3, please replace "sub sea" with -- subsea --.

Signed and Sealed this

Fifteenth Day of April, 2003

JAMES E. ROGAN
*Director of the United States Patent and Trademark Office*